United States Patent [19]

Frair et al.

[11] 4,005,827

[45] Feb. 1, 1977

[54] REFINER DISK

[75] Inventors: William J. Frair, Pittsfield; Robert P. Langdon, Savoy, both of Mass.

[73] Assignee: Beloit Corporation, Beloit, Wis.

[22] Filed: Apr. 30, 1975

[21] Appl. No.: 572,970

[52] U.S. Cl. ..... 241/261.3; 241/245; 241/298

[51] Int. Cl.[2] ..... B02C 7/12

[58] Field of Search ..... 241/244, 245, 261.2, 241/261.3, 297, 298; 51/206.4, 206.5

[56] References Cited

UNITED STATES PATENTS

| | | | |
|---|---|---|---|
| 421,727 | 2/1890 | Kimble | 51/206.5 |
| 1,865,523 | 7/1932 | Jeppson et al. | 51/206.5 |
| 3,158,333 | 11/1964 | Asplund et al. | 241/244 |
| 3,326,480 | 6/1967 | Jones | 241/297 |
| 3,841,573 | 10/1974 | Kahmann | 241/245 |

*Primary Examiner*—Granville Y. Custer, Jr.
*Assistant Examiner*—Howard N. Goldberg
*Attorney, Agent, or Firm*—Dirk J. Veneman; Gerald A. Mathews; Bruce L. Samlan

[57] ABSTRACT

A disk segment for use in a pulp refiner whereby a first portion of a side edge of the disk is offset relative to a second portion of the same side edge. The cooperating adjacent segment has substantially mating offset edges which cooperate with the adjacent segment in an overlapping and spaced apart relation.

3 Claims, 7 Drawing Figures

REFINER DISK

BACKGROUND OF THE INVENTION

Disk refiners are used in the paper manufacturing industry to prepare the cellulosic fibers of a paper pulp into a desired condition prior to delivery of the pulp to a paper making machine. In operation, a disk refiner is generally considered to exert a species of abrading action upon individual fibers in a pulp mass with the result that the side outermost layers of the individual cigar-shaped fibers are frayed, thereby increasing the surface area of the fiber greatly. The operation of a disk refiner is also generally considered to cause a rapid and frequent flexure over a brief time period of the individual fibers in a pulp mass with the result that the bond between the various concentric lamellae comprising an individual fiber are broken down or delaminated to a controlled, desired extent. The various actions of a disk refiner are accomplished in normal operation without significantly reducing the length or individual strength of the fibers.

The disk members have a working refining surface usually involving a plurality of raised, rib-like projections. In operation, these projections and other portions of the working surface are gradually abraded away, so that it is periodically necessary to shut down a disk refiner and replace the disks used therein.

There are many different types of disks and disk patterns which are well known in the industry. One type is a complete annular disk which is cast as a one piece doughnut shaped member. There are certain advantages in using this type of annular replacement disk in that it is fairly easy to install, and protects the rotor and the support members from wear as a result of the pulp eroding or washing the rotor and stationary mounting walls of the refiner from the abrasive flow of the material from the inner diameter of the refiner to the outer diameter thereof. The major disadvantage of the complete annular ring is the high cost associated therewith.

A second type of refiner disk comprises a plurality of individual segments which cooperatively form an annular ring. The advantage of the segmental disks is the ease of handling, the ability to replace only those segments which are worn and most importantly they are much less expensive to manufacture than the complete one piece annular disk. The disadvantages of the segmental disks are that increased machining time is necessary so that the adjacent disks will mate to form the annular ring and that the segments will fit within the physical constraints placed on them by the mounting surfaces within the refiner.

For purposes of economy, it is common practice to machine only those surfaces of a cast type segmental disk which is necessary to permit proper operation of the complete machine. As such, the disk side edges of are generally left in the "as cast" state and sizable allowances are made for the imperfect casting variations. In general, this has resulted in disks being considerably undersized on the side edges to insure that the disks will fit in the refiner. Therefore, rather sizable channels or spaces are defined between adjacent disks on the stationary mounting walls or rotor within the refiner. When undersized disks are used in the "as cast" edge condition, the abrasive materials flow through the channels beween the disks causing severe erosion and washing problems for the stationary walls and rotor of the refiner. The mounting surfaces in some instances, have become so eroded and left in a dangerously weakened state so that a severe safety problem results giving rise to potential injury to the operators. Furthermore, the erosion causes severe problems in the seating of the disk segments when replaced and substantially lessens the life of the replacement disk segments as well as the rotor and walls of the refiner.

The only present known solution to the above problem is to cast the disk segments in a slightly larger form, and machine down the side edges for a custom fitting job. This is extremely expensive and time consuming.

What is desired then, is to provide disk segments which could substantially minimize the adverse effects of erosion of the mounting surfaces of the refiner. It would further be desirable to provide segments which permit ease of installation. It would further be desirable to reuse existing foundry pattern equipment and overcome the above mentioned problems without increasing manufacturing costs.

SUMMARY OF THE INVENTION

A disk segment for use in a pulp refiner. The segment is defined by inner and outer arcuate peripheral edges, and two side edges connecting the peripheral edges. The edges cooperatively define an inner face and an outer face on the disk segment. A refining surface is projected on at least one of said faces. A first corner of the segment is defined by the intersection of a side edge, a peripheral edge, and the inner face of the segment. A second corner is defined by the intersection of the side edge, the first peripheral edge, and the outer face. The first and second corners are offset relative to each other in a direction normal to the refining surface so that the first corner projects further in an arcuate direction than the second corner.

On the other edge of the disk, a third corner is defined by the intersection of the second side edge, the first peripheral edge, and the outer face. A fourth corner is defined by the intersection of the second side edge, the first peripheral edge, and the inner face. The third and fourth corners are offset relative to each other in a direction normal to the refining surface so that the fourth corner projects further away from the segment in an arcuate direction than the third corner.

The adjacent segments are positioned on the mounting structure in an overlapping and spaced apart relation so that the first corner on one segment is adjacent to the fourth corner on the adjacent segment and the second corner on the one segment is adjacent the third corner on the adjacent segment.

In this manner, the disk edges can be left in the "as cast" state and yet allow for the sizable variances for casting conditions. The edges no longer have to be undersized as the offset portions of the edges cooperate with the offset portions of the edges of the adjacent disks in an overlapping and spaced relation. The sizable prior art channels between adjacent disks have been substantially reduced and a smaller tortuous path has resulted.

These new and improved edge structures on the disk segments substantially minimize the problem of erosion on the resulting mounting surfaces within the refiner. Furthermore, they are as easy to install as the prior art disk segments, their manufacturing process is identical to that previously used, present foundry pattern equipment can be utilized with only minor modification, and the overall manufacturing costs remain the same.

Figure 1:
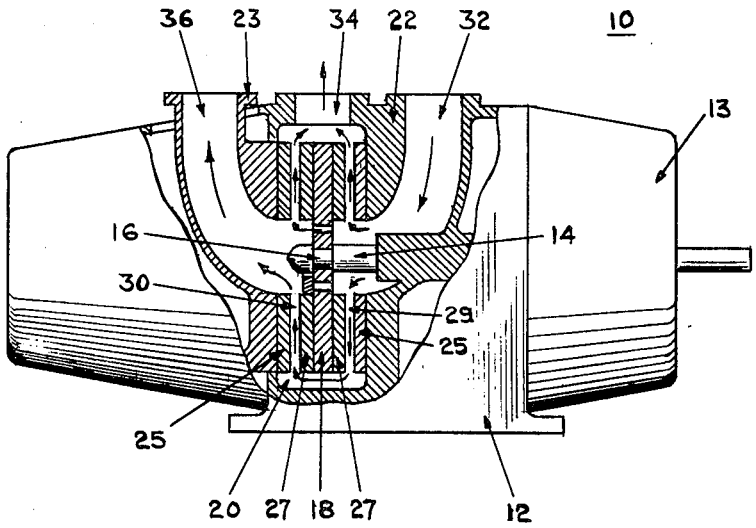
FIG. 1 is a simplified longitudinal view being partly in section of a refiner embodying the principles of the present invention.

DESCRIPTION OF THE PREFERRED EMBODIMENTS:

Referring to the drawings in general and more specifically to FIG. 1, there is shown a refiner 10. The refiner is generally of the type used for refining pulp stock utilized for making paper and the like. There are other ancillary uses for this type of equipment, as for example in the chemical and food industries.

The refiner 10 includes a base portion 12 and a housing 13. Power means are secured within or external to the housing 13 to drive a rotatable shaft 14. At the axial end of the shaft 16, is a radially extending rotor 18. The rotor is firmly secured to the shaft 14 by any suitable means as is well known in the art and rotates therewith. The rotor 18 is disposed within a refining cavity 20 defined within the housing 13. The axial portions of the refining cavity 20 are defined by interior annular walls 22 and 23 of the housing 13.

A plurality of refining segments 25 are disposed in an annular array around the walls 22 and 23. Each annular array defines the stationary refining segments.

A plurality of refining segments 27 are disposed on the opposite axial sides of the rotor 18. The refining segments 27 cooperatively define annular arrays of rotary refining surfaces.

The refining segments 25 and 27 are in spaced relation relative to each other and cooperatively define a first portion 29 of the refining cavity 20 and a second portion 30 of the refining cavity 20.

A stock inlet portion 32 is defined within the housing 13 and is in fluid communication with the refining cavity 20. A first outlet 34 is disposed radially above the rotor 18 and a second outlet 36 is disposed axially downstream of the rotor 18.

The refiner, as shown, is of the double disk type since there are two refining operations, i.e., in the first portion 29 and the second portion 30. It will be appreciated, however, that other types of refiners can be utilized.

Figure 2:
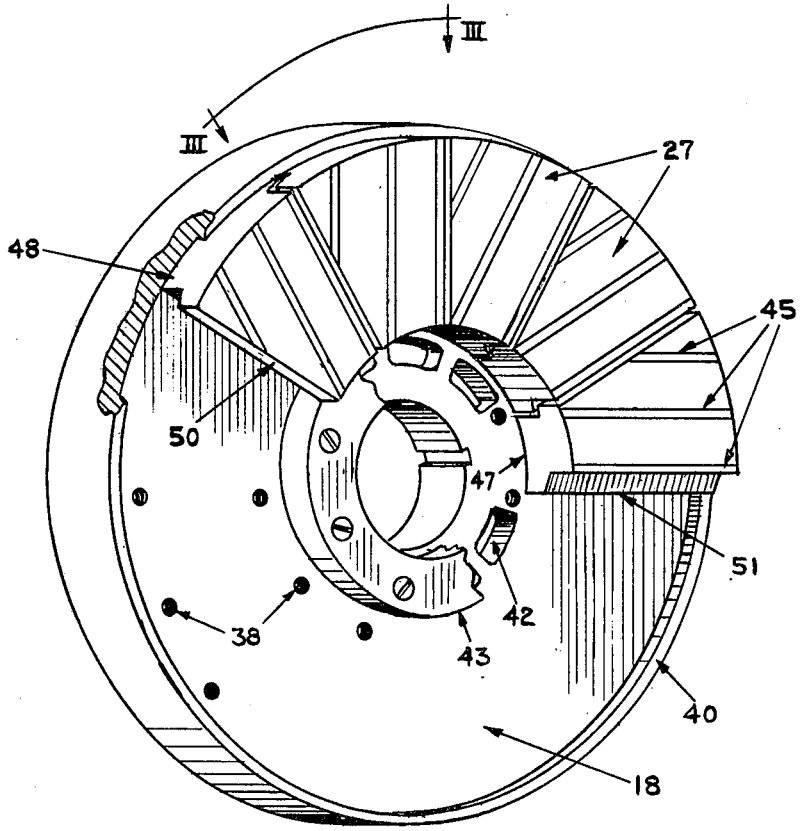
FIG. 2 is an enlarged view of the rotor of of the refiner shown in FIG. 1 with a portion of the segments mounted thereon.

As best seen in FIG. 2, the rotor 18 has a plurality of fastening holes 38 therein. As is well known in the art, the segments 27 are fastened by screw means (not shown) into fastening holes 38 as is shown in U.S. Pat. No. 3,326,480 which is hereby incorporated by reference. Around the outer periphery of the rotor is a flange 40 which assists in proper seating of the segments 27 on the rotor. A plurality of passages 42 are defined in an annular array around a radially inner portion of the rotor 18. An optional annular cover plate 43 can be fastened to the rotor 18 to block the passages 42. When the cover plate is fastened to the rotor 18, the flow from the inlet 32 goes through the first portion 29 of the cavity 20, around the outer peripheral edge of the rotor 18, and through the second portion 30 of the refining cavity of the second outlet 36. This is commonly referred to as a monoflow refining flow path (indicated by the dashed lines in FIG. 1).

In an optional mode of operation, with the plate 43 removed stock enters through the inlet 32 and flows through the first portion 29 of the refining cavity, through the passages 42, through the second portion 30 of the refining cavity and out through the first outlet 34 (indicated by the solid lines in FIG. 1). This is commonly referred to as a 2-pipe dual flow refining path.

There are many different patterns for refining surfaces on refining segments. As best seen in FIG. 2, one pattern includes a plurality of raised refining surfaces 45 comprising a plurality of parallel surfaces in spaced relation thereto and being of varying length. On a particular segment 27, the pattern of the refining surfaces 45 is repeated three times.

In accordance with the principles of the present invention, each refining segment 25, 27 includes an inner arcuate peripheral edge 47. Since all of the segments are substantially the same, the specific numbered references will apply to all segments. There is an outer arcuate peripheral edge 48 radially opposed to said inner edge 47. A radially extending first side edge 50 connects the inner peripheral edge 47 and the outer peripheral edge 48. A second radially extending side edge 51 disposed opposite said first side edge connects the inner edge 47 and the outer edge 48. Some side edges may deviate from true radial lines by some small angle up to about 20°, but all such edges shall be defined as radial.

Figure 3:
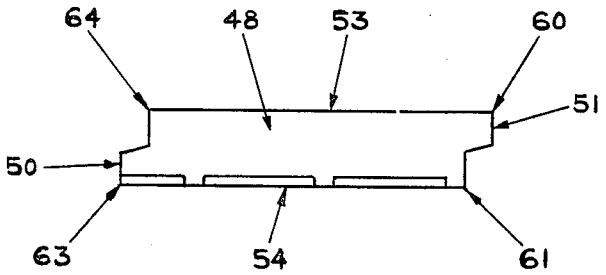
FIG. 3 is a view taken substantially along lines III—III of FIG. 2.

The inner edge 47, the outer edge 48, the first side edge 50, and the second side edge 51, cooperatively define an inner face 53 and an outer face 54 (FIG. 3). The raised refining surfaces 45 are formed on the outer face 54 of the refining segments. The inner face 53 is mounted directly in contact with either the rotor 18 or the annular walls 22 and 23. This can best be seen in FIGS. 2, 3, and 5. The first and second side edges 50 and 51 include all of the surface wall portions defining the end portion thereof which connects the inner and outer peripheral edges 47 and 48.

The second side edge 51 (FIGS. 4 and 5) includes a radially extending straight wall portion 56, said portion projecting from the inner face 53. Another radially extending straight wall portion 57 projects from the outer face 54. A sloped wall portion 58 which is substantially straight and extending in a radial direction connects the two straight wall portions 56 and 57. A first corner 60 of the segment 27 is defined by the intersection of the wall portion 56 of the second side edge 51, the inner face 53, and the outer peripheral edge 48. A second corner 61 is defined by the intersection of the wall portion 57 of the second side edge 51, the outer face 54, and the outer edge 48. The first corner 60 is offset relative to the second corner 61 in a direction normal to the refining surfaces 45 so that the first corner 60 projects further than the second corner 61 in an arcuate direction as indicated by the dimension A.

Figure 4:
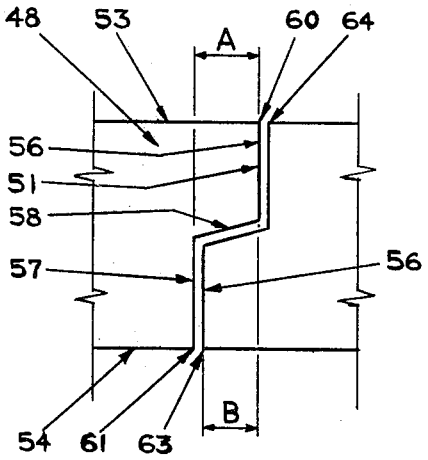
FIG. 4 is an enlarged detail plan view showing the overlapping features of the present invention.
Figure 5:
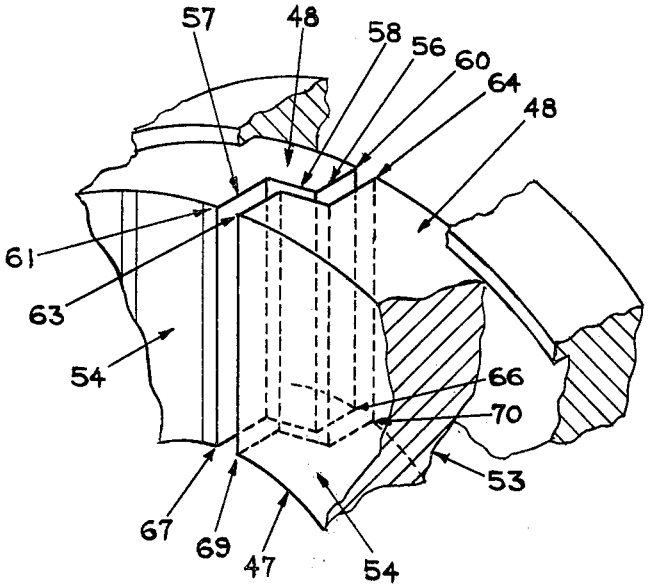
FIG. 5 is a perspective view showing the overlapping feature of the present invention.

On the opposite edge of the segment 27 is a third corner 63 (FIGS. 3, 4 and 5). The third corner is defined by the intersection of the first side edge 50, the outer peripheral edge 48, and the outer face 54. A fourth corner 64 is defined by the intersection of the first side edge 50, the outer peripheral edge 48, and the inner face 53. The third corner 63 is offset relative to the fourth corner 64 in a direction normal to the refining surfaces 45 so that the third corner projects further away from the segment in an arcuate direction than the fourth corner 64. The projected offset is equal to the same offset A from the first and second corners 60 and 61, respectively. The projecting corners 60 and 63, and corners 61 and 64 are diametrically opposed to each other on the same segment 27.

As can best be seen in FIG. 5, the first corner 60 and the second corner 61 on the outer peripheral edge 48 have corresponding corners 66 and 67, respectively, on the inner peripheral edge 47. Correspondingly, on the opposite side edge of the segment 27, the third corner 63 and fourth corner 64 have corresponding corners 69 and 70, respectively.

The adjacent cooperating segments are substantially identical and are numbered the same as the segment 27. It can be seen by reference to FIGS. 2, 4, and 5 that the adjacent segments are positioned on the rotor 18 and/or the annular walls 22 and 23 in an overlapping and spaced relation. Referring to the outer peripheral edge 48, corners 60 and 64 are adjacent and corners 61 and 63 are adjacent. Likewise referring to the inner peripheral edge 47, corners 67 and 69 are adjacent as are corners 66 and 70. With reference to FIG. 4, it can be seen that the two adjacent segments are positioned in a manner so that corner 60 overlaps corner 63 by the projected distance B. Likewise, straight wall portion 56 overlaps the corresponding straight wall portion 56 of the adjacent segment by the dimension B. A similar overlap occurs for the corners on the inner peripheral edge 47. The corners are offset relative to each other in a direction normal to the refining surface 45 on the outer face 54 of the segment.

Figure 6:
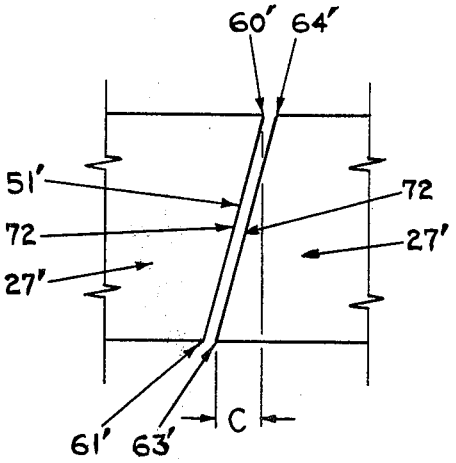
FIG. 6 is a view similar to FIG. 4, but showing another embodiment of the present invention.

A second embodiment is shown in FIG. 6. The refining segments are substantially identical with the refining segments previously referred to in the first embodiment. However, the side edges 51' include a substantially straight inclined or biased wall 72 instead of straight wall portions 56, 57, and sloped wall portion 58. It can be seen that the refining segments 27' adjacent to each other have the respective first corner 60' and fourth corner 64' adjacent each other, as well as second corner 61' and third corner 63'. Corners 60' and 61' are offset relative to each other so that the first corner 60' projects further in an arcuate direction than the second corner 61'. Correspondingly, on the other side of the segment or on the adjacent segment, fourth corner 64' is offset relative to third corner 63'. Corner 63' projects further in an arcuate direction than the fourth corner 64'. The adjacent segments are, therefore, positioned on either the rotor 18 and/or the annular walls 22 and 23 in an overlapping relation and in a directon normal to the refining surfaces of the segments 27' by a projected distance represented by C.

Figure 7:
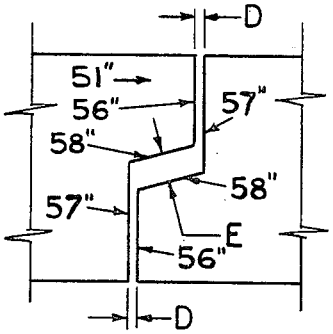
FIG. 7 is a view similar to FIG. 4, but showing a third embodiment of the present invention.

A third embodiment is shown in FIG. 7. The refining segments are substantially identical with the refining segments previously referred to in the first embodiment except for a dimensional change in the side edges and a change in the overlap.

A straight wall portion 56'' is adjacent a corresponding straight wall portion 57'' on the adjacent segment and a second straight wall portion 57'' is adjacent a corresponding straight wall portion 56''. The straight wall portions 56'' and 57'' are spaced apart from each other by the dimension D.

The straight wall portions 56'' and 57'' are joined together by sloped wall portion 58''. The adjacent sloped wall portions 58'' are spaced apart from each other by the dimension E.

As shown, E is greater than D defining a channel E between the segment which would cause fluid therein to have a lower velocity than pulp in channels D. This causes fibrous material within the fluid to settle within channel E. Over a period of time, the fibrous material will completely block the channel and provide additional protection against the abrasion and erosion of the pulp against the mounting surfaces, making this embodiment the most effective of the three embodiments shown.

By way of example, typical dimensional ranges are A — ⅜ to ½ inches; D — 0.0 to 0.06 inches; and E — 0.06 to 0.125 inches although other dimensions could be utilized and under certain instances, E could be less than D and the two D dimensions could be different. Thus it can be seen that "spaced apart" encompasses the embodiment where D is zero but E defines a space between walls 58''.

The photo in Table 1 shows an actual rotor structure utilized on a refiner. It can readily be observed the serious problem associated with present refining segments. These segments were left in the as cast state with sizable allowances being made for the casting variations. This results in a channel or spacing between the adjacent side edges of the disks. As the pulp goes from the radially inner portion of the disks to the outer portion, the material flow causes erosion of the rotors and/or stationary annular walls of the refiner. After continued use and because of the abrasive nature of the pulp, severe channels are eroded into the rotor or wall portions of the refiner. This is indicated by the large channels which can be seen in the photograph on both the outer arcuate peripheral edge and the side edges between adjacent segments. It is extremely difficult to mount replacement disks thereon after the erosion has begun and any disks which are mounted thereon are subject to premature disk life. Furthermore, because of the erosion, the rotor and the stationary annular walls can create a hazard.

The present invention provides a plurality of refining segments which allows the edges to be left in the "as cast" state. This permits the use of sizable variances for casting conditions. Furthermore, the edges of the adjacent disks now overlap and are not undersized. By overlapping the adjacent edges, the flow through the channels are substantially minimized. This in turn greatly reduces the erosion on the mounting surfaces within the refiner. The overall costs and use of existing foundry equipment can be utilized with only minor modifications with almost no increase in manufacturing costs.

It will be obvious to those skilled in the art that the invention is not limited to the embodiments shown, but is susceptible to various other changes without departing from the spirit thereof.

What is claimed is:

1. A plurality of disk shaped segments for refining material within a refiner, said segments being arranged in an annular array within said refiner, said segments having inner and outer peripheral edges connected by two opposed side edges, each of said side edges having offset portions thereon, each of the adjacent segments being positioned within said refiner so that said offset portions of one of said side edges cooperates with the offset portions of the adjacent side edge in an overlapping and spaced apart relation.

2. The structure recited in claim 1 wherein the refiner includes a first stationary wall and a rotor structure, a first array of segments being disposed on said stationary wall and a second array of segments being disposed on said rotor structure, said first and second arrays being in spaced relation from each other and defining a first refining cavity.

3. The structure recited in claim 2 and further including a second stationary wall, a third array of segments being disposed on said stationary wall and a fourth array of segments being disposed on the corrsponding opposing side of the rotor structure, said third and fourth arrays being in spaced apart relation and defining a second refining cavity.

4. The structure recited in claim 3 wherein said first and second cavities are in fluid communication.

5. The structure recited in claim 2 wherein each of said segments has a raised refining surface thereon, said surfaces mutually facing each other in said first and second arrays.

6. The structure recited in claim 1 wherein each of the offset portions of the side edges define a first straight wall portion, a second straight wall portion, and an intermediate sloped wall portion connecting said first and second straight wall portions.

7. The structure recited in claim 6 wherein said first straight wall portion of one segment overlaps a corresponding offset straight wall portion of an adjacent segment.

8. The structure recited in claim 1 wherein each side edge defines a single straight wall, said wall being inclined relative to and extending from one side of the segment to the other, so that one portion of the straight wall portion is offset relative to the other.

9. The structure recited in claim 8 wherein one portion of the straight wall portion of the side of the segment is in overlapping relation with a mating and corresponding sloped straight wall portion of an adjacent segment.

10. The structure recited in claim 1 wherein the side edges of adjacent segments are spaced apart by at least two different dimensions, one of said dimensions being greater in size than the other to define a low velocity area.

11. A disk segment for use in a refiner, said segment comprising:

inner and outer arcuate peripheral edges;

two side edges connecting said peripheral edges, said side edges and said peripheral edges cooperatively defining an inner face and an outer face;

a refining surface on at least one of said faces;

a first corner defined by the intersection of a first side edge, a first peripheral edge and said outer face;

a second corner defined by the intersection of said first side edge, said first peripheral edge and said inner face;

said corners being offset relative to each other in a direction normal to said refining surface, and said first corner projecting further away from the segment in an arcuate direction than said second corner, a third corner being defined by the intersection of a second side edge, said first peripheral edge and said outer face;

a fourth corner defined by the intersection of said second side edge, said first peripheral edge and said inner face;

said corners being offset relative to each other in a direction normal to said defining surface, said fourth corner projecting further from the segment in an arcuate direction than said third corner.

12. In a refiner for refining stock, said refiner including a rotatable structure and a stationary structure, said structures cooperatively defining a first refiner zone, a plurality of refining segments disposed on said structures, said refining segments on each of said structures cooperating with other segments to define an annular shaped refining surface, each of said segments including outer and inner arcuate peripheral edges, and two side edges connecting said peripheral edges, said edges defining an inner face and an outer face, the improvement comprising:

each of said segments defining a first corner along the intersection of a first side edge, a first peripheral edge and said inner face;

each of said segments defining a second corner along the intersection of said first side edge, said first peripheral edge and said outer face;

said second corner being offset relative to said first corner in an axial direction;

said side edges of said adjacent segments positioned on said structure in overlapping relation so that a first corner on one segment is in closely spaced apart relation to the second corner on the adjacent segment, and said second corner on said one segment is in closely spaced apart relation to the first corner on the adjacent segment.

13. The structure recited in claim 12 wherein the side edges of adjacent segments are spaced apart by at least two different dimensions, one of said dimensions being greater in size than the other to define a low velocity area.

* * * * *

UNITED STATES PATENT AND TRADEMARK OFFICE

CERTIFICATE OF CORRECTION

PATENT NO. : 4,005,827

DATED : February 1, 1977

INVENTOR(S) : William J. Frair and Robert P. Langdon

It is certified that error appears in the above-identified patent and that said Letters Patent are hereby corrected as shown below:

After the Abstract, the number of claims should be changed from "3" to --13--.

Column 8, line 22, "defining" should be changed to --refining--.

Signed and Sealed this

Twelfth Day of April 1977

[SEAL]

*Attest:*

RUTH C. MASON
*Attesting Officer*

C. MARSHALL DANN
*Commissioner of Patents and Trademarks*